US010830072B2

(12) United States Patent
Albert

(10) Patent No.: US 10,830,072 B2
(45) Date of Patent: Nov. 10, 2020

(54) TURBOMACHINE AIRFOIL

(71) Applicant: General Electric Company, Schenectady, NY (US)

(72) Inventor: Jason Edward Albert, Greenville, SC (US)

(73) Assignee: General Electric Company, Schenectady, NY (US)

( * ) Notice: Subject to any disclaimer, the term of this patent is extended or adjusted under 35 U.S.C. 154(b) by 316 days.

(21) Appl. No.: 15/657,558

(22) Filed: Jul. 24, 2017

(65) Prior Publication Data

US 2019/0024519 A1 Jan. 24, 2019

(51) Int. Cl.

| | |
|---|---|
| ***F01D 25/12*** | (2006.01) |
| ***F01D 9/04*** | (2006.01) |
| ***F01D 9/06*** | (2006.01) |

(52) U.S. Cl.

CPC ..... *F01D 9/041* (2013.01); *F01D 9/065* (2013.01); *F01D 25/12* (2013.01); *F05D 2220/32* (2013.01); *F05D 2240/122* (2013.01); *F05D 2250/11* (2013.01); *F05D 2250/323* (2013.01); *F05D 2260/2212* (2013.01)

(58) Field of Classification Search

CPC .... F01D 9/041; F01D 25/12; F05D 2240/122; F05D 2260/2212; F05D 2220/32

See application file for complete search history.

(56) References Cited

U.S. PATENT DOCUMENTS

| | | | | |
|---|---|---|---|---|
| 3,650,635 | A | 3/1972 | Wachtell et al. | |
| 4,026,659 | A | 5/1977 | Freeman, Jr. | |
| 4,155,523 | A | 5/1979 | Morford et al. | |
| 4,515,523 | A * | 5/1985 | North | F01D 5/187 415/115 |
| 5,288,207 | A | 2/1994 | Linask | |
| 5,700,132 | A * | 12/1997 | Lampes | F01D 5/187 415/115 |
| 5,772,397 | A * | 6/1998 | Morris | F01D 5/187 415/115 |
| 6,402,470 | B1 * | 6/2002 | Kvasnak | F01D 5/187 415/115 |
| 6,575,702 | B2 | 6/2003 | Jackson et al. | |
| 6,599,092 | B1 * | 7/2003 | Manning | F01D 5/187 415/115 |

(Continued)

*Primary Examiner* — Phutthiwat Wongwian
*Assistant Examiner* — Diem T Tran
(74) *Attorney, Agent, or Firm* — Dority & Manning, P.A.

(57) ABSTRACT

The present disclosure is directed to a turbomachine airfoil including an exterior wall having a trailing edge. The exterior wall defines a radially-extending cooling cavity and one or more trailing edge cooling passages extending through the exterior wall. Each trailing edge cooling passage includes an inlet in fluid communication with the cooling cavity and a first portion in fluid communication with the inlet. Each trailing edge cooling passage also includes a second portion in fluid communication with the first portion. The second portion includes a first outlet defined by the exterior wall at the trailing edge. Each trailing edge cooling passage further includes a third portion in fluid communication with the first portion. The third portion includes a second outlet defined by the exterior wall at the trailing edge. The second and third portions are separated by a rib extending upstream from the trailing edge.

16 Claims, 7 Drawing Sheets

(56) References Cited

U.S. PATENT DOCUMENTS 6,602,047 B1 * 8/2003 Barreto ..... F01D 5/187 415/1
6,607,356 B2 * 8/2003 Manning ..... F01D 5/187 416/97 R
7,033,140 B2 * 4/2006 Gregg ..... F01D 5/16 416/135
7,156,620 B2 * 1/2007 Papple ..... F01D 5/187 415/115
7,731,481 B2 * 6/2010 Cunha ..... B22C 9/04 29/889.721
8,070,441 B1 12/2011 Liang
8,096,770 B2 1/2012 Liang
8,182,225 B2 5/2012 Krueckels et al.
8,360,725 B2 * 1/2013 Anguisola McFeat ..... F01D 5/187 416/96 R
8,613,597 B1 * 12/2013 Liang ..... F01D 5/187 416/97 R
8,840,363 B2 9/2014 Lee
8,882,461 B2 * 11/2014 Morris ..... F01D 5/187 416/97 R
9,051,842 B2 * 6/2015 Smith ..... F01D 5/186
9,995,145 B2 * 6/2018 Propheter-Hinckley ..... F01D 9/041
2002/0021966 A1 * 2/2002 Kvasnak ..... F01D 5/187 416/97 R
2005/0053459 A1 * 3/2005 Cunha ..... F01D 5/186 415/115
2006/0073017 A1 * 4/2006 Manning ..... F01D 5/186 416/97 R
2006/0239819 A1 * 10/2006 Albert ..... B22C 9/04 416/97 R
2007/0258814 A1 * 11/2007 Metrisin ..... F01D 5/147 416/97 R
2007/0286735 A1 * 12/2007 Cunha ..... F01D 5/187 416/97 R
2008/0050243 A1 * 2/2008 Liang ..... F01D 5/187 416/97 R
2008/0101961 A1 * 5/2008 Liang ..... F01D 5/187 416/97 R
2010/0074762 A1 * 3/2010 Liang ..... F01D 5/186 416/97 R
2010/0239412 A1 * 9/2010 Draper ..... F01D 5/186 415/115
2011/0264413 A1 10/2011 Stankowski et al.
2012/0269649 A1 * 10/2012 Rawlings ..... F01D 5/187 416/97 R
2013/0243575 A1 * 9/2013 Zelesky ..... F01D 5/187 415/116
2013/0343872 A1 * 12/2013 Tibbott ..... F01D 5/186 415/115
2014/0010666 A1 * 1/2014 Hudson ..... F01D 5/186 416/97 R
2014/0064983 A1 * 3/2014 Jones ..... F01D 5/187 416/97 R
2014/0105726 A1 * 4/2014 Lee ..... F01D 5/188 415/115
2015/0198049 A1 * 7/2015 Jung ..... F01D 5/187 416/1
2015/0204237 A1 * 7/2015 Zemitis ..... F02C 3/04 60/805
2016/0069189 A1 * 3/2016 Quach ..... B22C 9/103 416/241 B
2016/0169004 A1 * 6/2016 Quach ..... F01D 5/186 60/752
2016/0251968 A1 * 9/2016 Quach ..... F01D 5/187 60/754
2017/0058678 A1 * 3/2017 Lee ..... F01D 5/187
2017/0145833 A1 * 5/2017 Thornton ..... F01D 5/187
2017/0306765 A1 * 10/2017 Walunj ..... F01D 5/187
2018/0045056 A1 * 2/2018 Wiedenhoefer ..... F01D 5/189
2018/0209286 A1 * 7/2018 Spangler ..... F01D 5/186

* cited by examiner

TURBOMACHINE AIRFOIL

FIELD

The present disclosure generally relates to turbomachines. More particularly, the present disclosure relates to airfoils for turbomachines.

BACKGROUND

A gas turbine engine generally includes a compressor section, a combustion section, and a turbine section. The compressor section progressively increases the pressure of air entering the gas turbine engine and supplies this compressed air to the combustion section. The compressed air and a fuel (e.g., natural gas) mix within the combustion section and combust in a combustion chamber to generate high pressure and high temperature combustion gases. The combustion gases flow from the combustion section into the turbine section where they expand to produce work. For example, expansion of the combustion gases in the turbine section may rotate a rotor shaft connected to a generator for producing electricity.

The turbine section includes one or more turbine nozzles, which direct the flow of combustion gases onto one or more turbine rotor blades. The one or more turbine rotor blades, in turn, extract kinetic and/or thermal energy from the combustion gases, thereby driving the rotor shaft. In general, each turbine nozzle includes an inner side wall, an outer side wall, and one or more airfoils extending between the inner and the outer side walls. Each airfoil, in turn, includes an exterior wall having a leading edge and a trailing edge.

Since the one or more airfoils are in direct contact with the combustion gases, it is generally necessary to cool the airfoils. In this respect, the airfoil defines various cooling channels and passages through which a coolant (e.g., bleed air from the compressor section) flows. The trailing edge of the airfoil typically experiences the greatest temperatures during operation of the gas turbine engine. In this respect, at least a portion of the coolant flowing through the airfoil is routed to the trailing edge. Nevertheless, the cooling capacity of the coolant flowing is substantially diminished when the coolant reaches the trailing edge.

BRIEF DESCRIPTION

Aspects and advantages of the technology will be set forth in part in the following description, or may be obvious from the description, or may be learned through practice of the technology.

In one aspect, the present disclosure is directed to a turbomachine airfoil including an exterior wall having a trailing edge. The exterior wall defines a radially-extending cooling cavity and one or more trailing edge cooling passages extending through the exterior wall. Each trailing edge cooling passage includes an inlet in fluid communication with the cooling cavity and a first portion in fluid communication with the inlet. The first portion narrows in a downstream direction. Each trailing edge cooling passage also includes a second portion in fluid communication with the first portion. The second portion includes a first outlet defined by the exterior wall at the trailing edge. Each trailing edge cooling passage further includes a third portion in fluid communication with the first portion. The third portion includes a second outlet defined by the exterior wall at the trailing edge. The second and third portions are separated by a rib extending upstream from the trailing edge.

In another aspect, the present disclosure is directed to a turbomachine including one or more turbine section components. Each turbine section component including one or more airfoils. Each airfoil includes an exterior wall having a trailing edge. The exterior wall defines a radially-extending cooling cavity and one or more trailing edge cooling passages extending through the exterior wall. Each trailing edge cooling passage includes an inlet in fluid communication with the cooling cavity and a first portion in fluid communication with the inlet. The first portion narrows in a downstream direction. Each trailing edge cooling passage also includes a second portion in fluid communication with the first portion. The second portion includes a first outlet defined by the exterior wall at the trailing edge. Each trailing edge cooling passage further includes a third portion in fluid communication with the first portion. The third portion includes a second outlet defined by the exterior wall at the trailing edge. The second and third portions are separated by a rib extending upstream from the trailing edge.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode of practicing the various embodiments, is set forth in the specification, which makes reference to the appended figures, in which.

Figure 1:
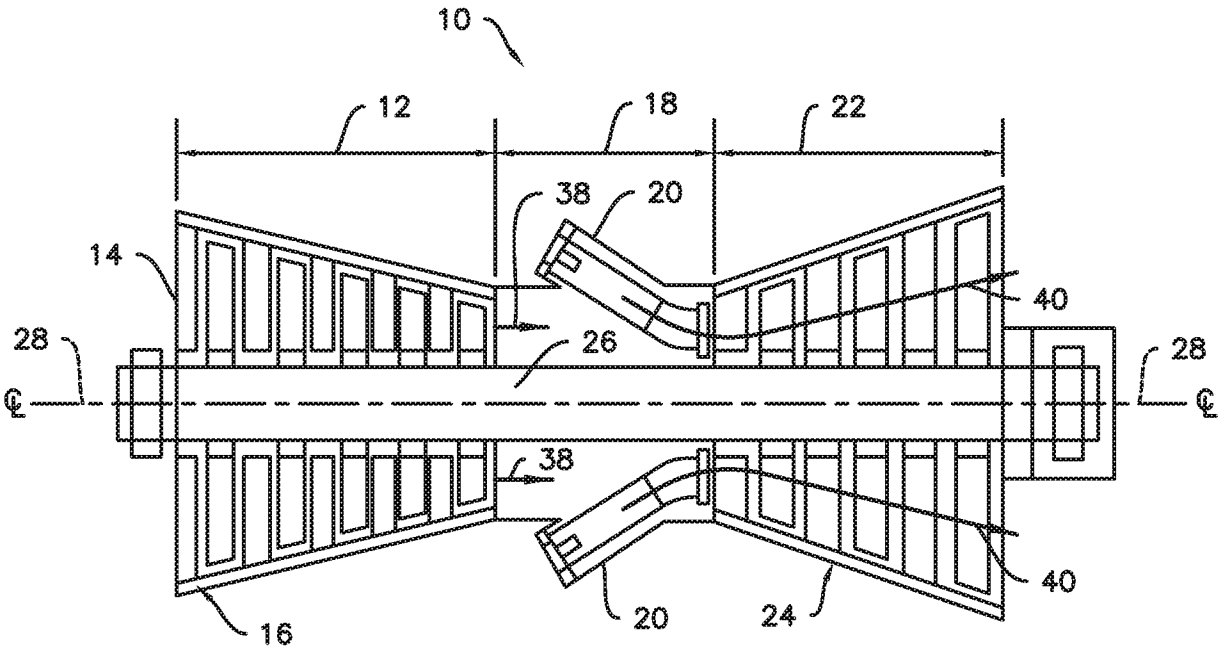
FIG. 1 is a schematic view of an exemplary gas turbine engine in accordance with embodiments of the present disclosure.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. As shown, the gas turbine engine 10 generally includes a compressor section 12 having an inlet 14 disposed at an upstream end of an axial compressor 16. The gas turbine engine 10 also includes a combustion section 18 having one or more combustors 20 positioned downstream from the compressor 16. The gas turbine engine 10 further includes a turbine section 22 having a turbine 24 (e.g., an expansion turbine) disposed downstream from the combustion section 18. A shaft 26 extends axially through the compressor 16 and the turbine 24 along an axial centerline 28 of the gas turbine engine 10.

Figure 2:
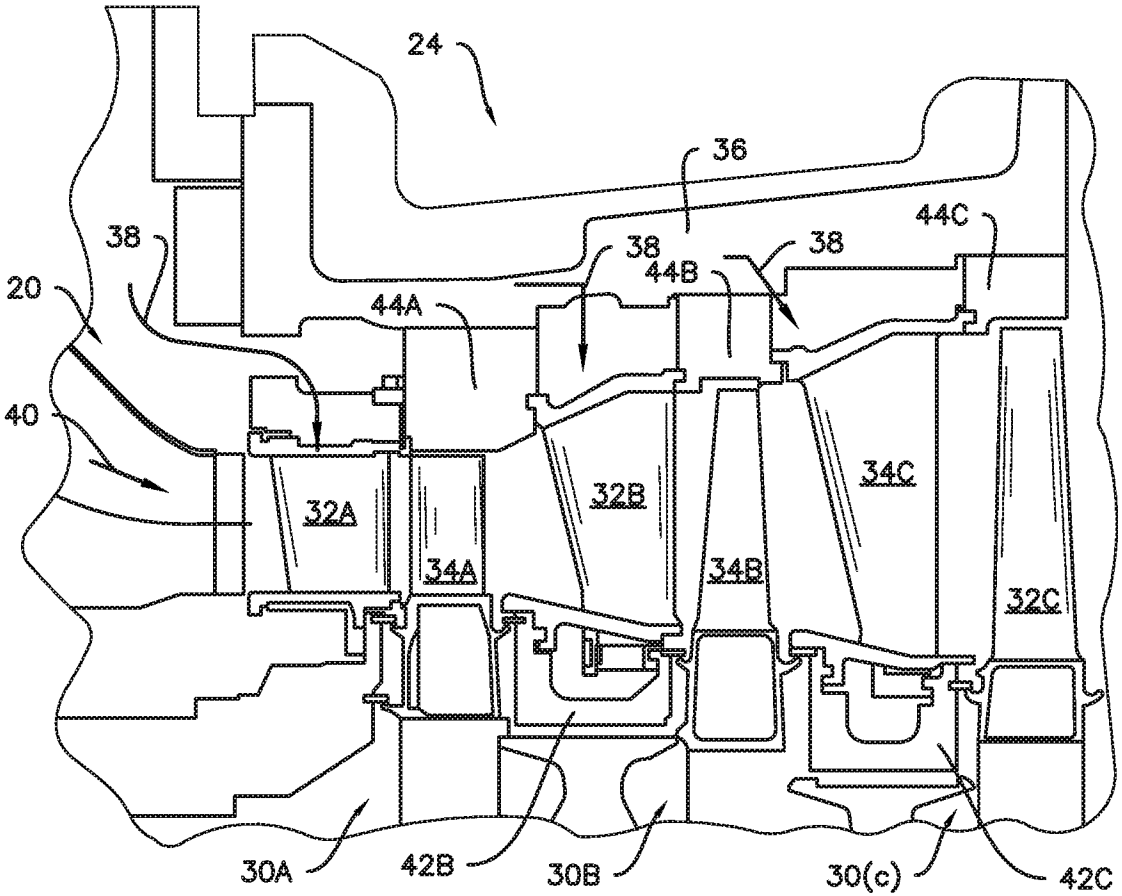
FIG. 2 is a cross-sectional view of an exemplary turbine section in accordance with embodiments of the present disclosure.

FIG. 2 is a cross-sectional side view of the turbine 24. As shown, the turbine 24 may include multiple turbine stages. For example, the turbine 24 may include a first stage 30A, a second stage 30B, and a third stage 30C. Although, the turbine 24 may include more or fewer turbine stages in alternate embodiments.

Each stage 30A-30C includes, in serial flow order, a corresponding row of turbine nozzles 32A, 32B, and 32C and a corresponding row of turbine rotor blades 34A, 34B, and 34C axially spaced apart along the rotor shaft 26 (FIG. 1). Each of the turbine nozzles 32A-32C remains stationary relative to the turbine rotor blades 34A-34C during operation of the gas turbine 10. Each of the rows of turbine nozzles 32B, 32C is respectively coupled to a corresponding diaphragm 42B, 42C. Although not shown in FIG. 2, the row of turbine nozzles 32A may also couple to a corresponding diaphragm. A first turbine shroud 44A, a second turbine shroud 44B, and a third turbine shroud 44C circumferentially enclose the corresponding row of turbine blades 34A-34C. A casing or shell 36 circumferentially surrounds each stage 30A-30C of the turbine nozzles 32A-32C and the turbine rotor blades 34A-34C.

As illustrated in FIGS. 1 and 2, the compressor 16 provides compressed air 38 to the combustors 20. The compressed air 38 mixes with a fuel (e.g., natural gas) in the combustors 20 and burns to create combustion gases 40, which flow into the turbine 24. The turbine nozzles 32A-32C and turbine rotor blades 34A-34C extract kinetic and/or thermal energy from the combustion gases 40, thereby driving the rotor shaft 26. The combustion gases 40 then exit the turbine 24 and the gas turbine engine 10. As will be discussed in greater detail below, a portion of the compressed air 38 may be used as a coolant for cooling the various components of the turbine 24, such as the turbine nozzles 32A-32C.

Figure 3:
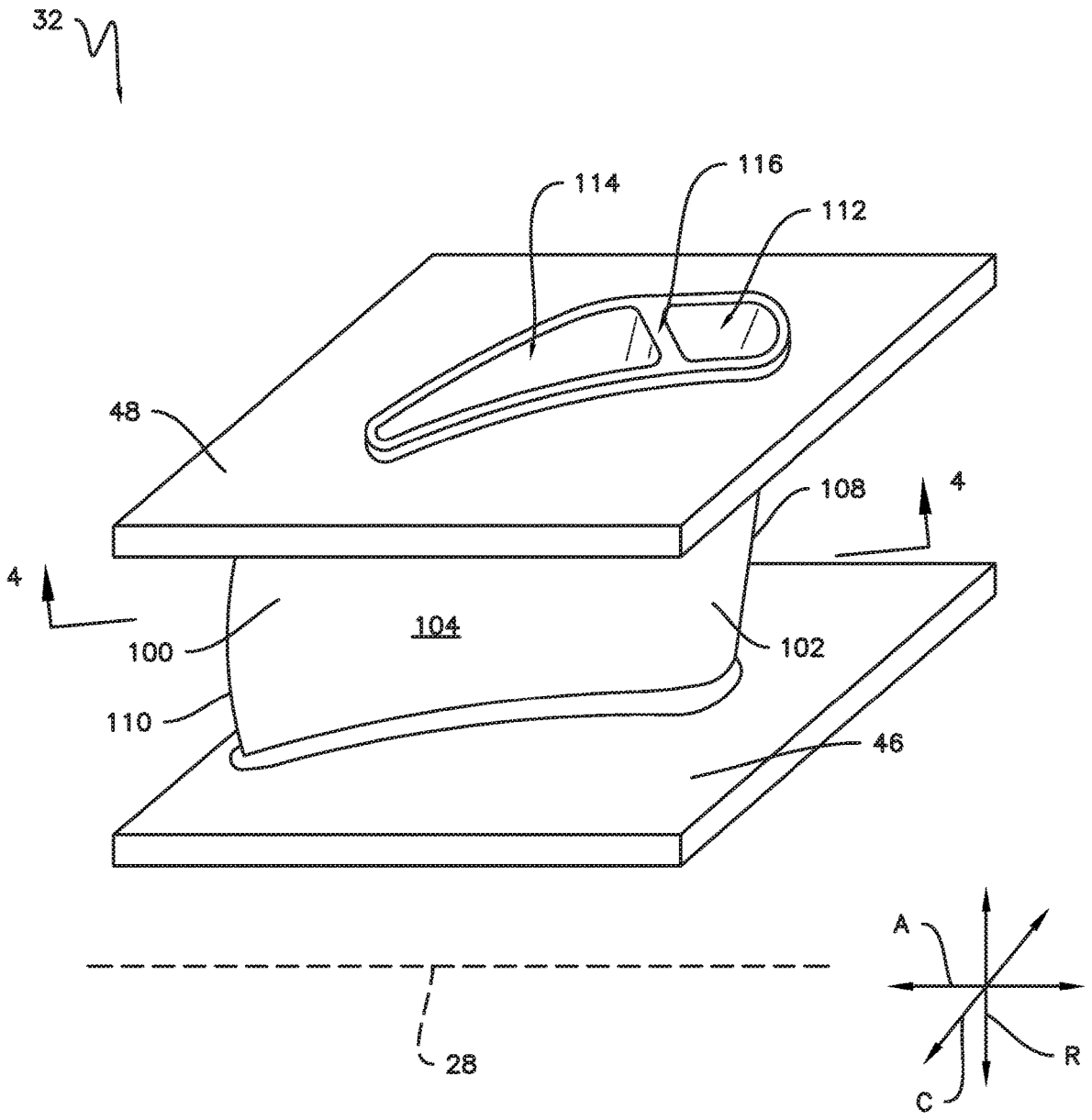
FIG. 3 is a perspective view of an exemplary nozzle in accordance with embodiments of the present disclosure.

FIG. 3 is a perspective view of a turbine nozzle 32, which may be incorporated into the gas turbine engine 10 in place of or in addition to one or more of the turbine nozzles 32A-32C shown in FIG. 2. As shown, the turbine nozzle 32 defines an axial direction A, a radial direction R, and a circumferential direction C. In general, the axial direction A extends parallel to the axial centerline 28, the radial direction R extends orthogonally outward from the axial centerline 28, and the circumferential direction C extends concentrically around the axial centerline 28.

As shown in FIG. 3, the turbine nozzle 32 includes an inner side wall 46 and an outer side wall 48 radially spaced apart from the inner side wall 46. An airfoil 100 extends in span from the inner side wall 46 to the outer side wall 48. In this respect, the turbine nozzle 32 illustrated in FIG. 3 is referred to in industry as a singlet. Nevertheless, the turbine nozzle 32 may have two airfoils 100 (i.e., a doublet), three airfoils 100 (i.e., a triplet), or more airfoils 100.

Figure 4:
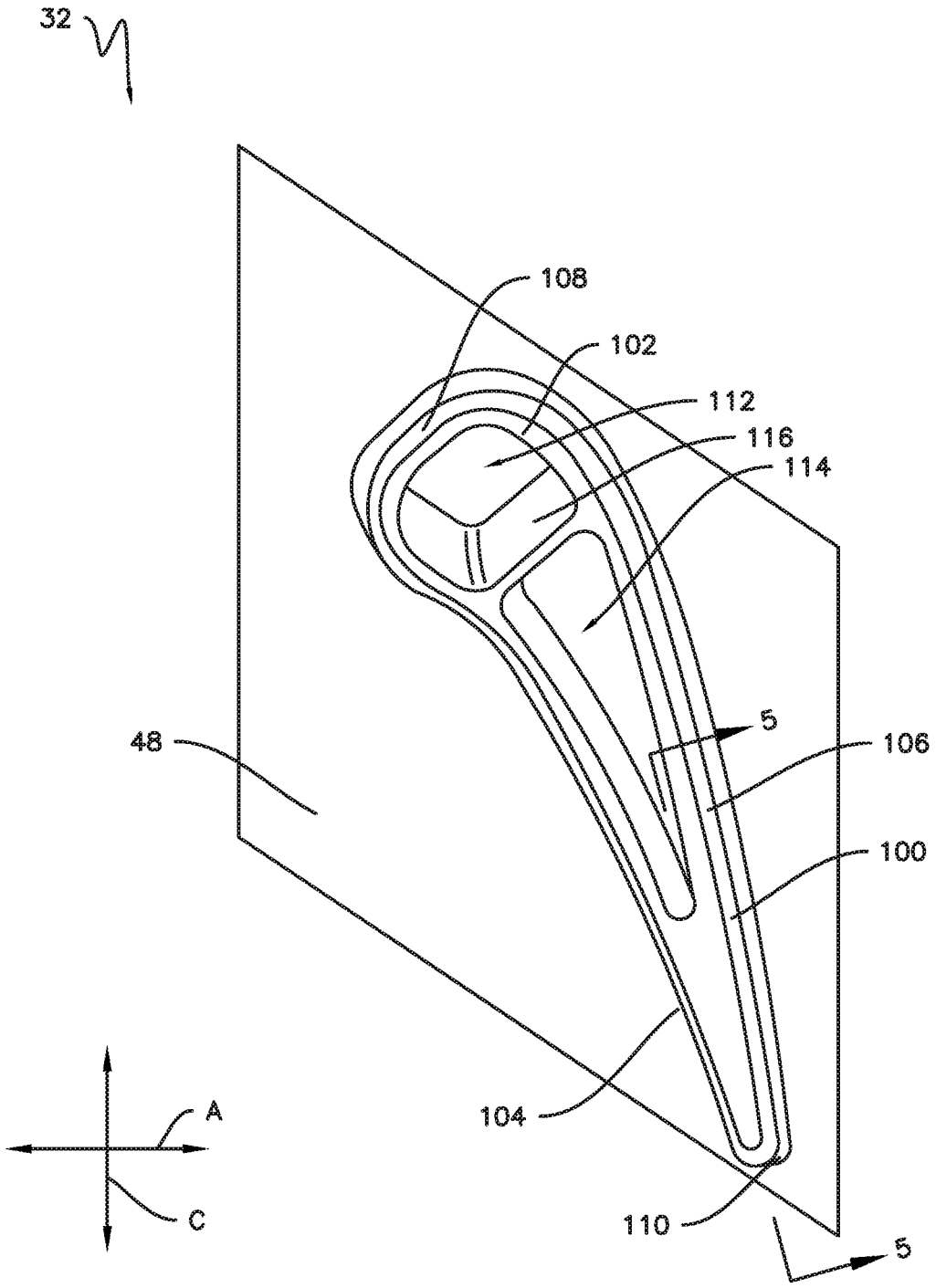
FIG. 4 is a cross-sectional view of the nozzle taken generally about line 4-4 in FIG. 3 in accordance with embodiments of the present disclosure.

Referring now to FIGS. 3 and 4, the airfoil 100 includes an exterior wall 102. More specifically, the exterior wall 102 includes a pressure-side surface 104 and an opposing suction-side surface 106. The pressure-side and suction-side surfaces 104, 106 are joined together or interconnected at a leading edge 108 of the airfoil 100 and at a trailing edge 110 of the airfoil 100. In this respect, the leading edge 108 is oriented into the flow of combustion gases 40 (FIG. 1), while the trailing edge 110 is spaced apart from and positioned downstream of the leading edge 108. Furthermore, the pressure-side surface 104 is generally concave, and the suction-side surface 106 is generally convex.

The airfoil 100 defines one or more radially-extending cooling cavities therein. In the embodiment illustrated in FIGS. 3 and 4, the airfoil 106 defines a forward radially-extending cooling cavity 112 and an aft radially-extending cooling cavity 114. A rib 16 may separate the forward and the aft cavities 112, 114. In certain embodiments, an insert (not shown) may be positioned in each of the cooling cavities 112, 114. During operation of the gas turbine engine 10, a coolant (e.g., a portion of the compressed air 38) may flow through the cavities 112, 114 or any inserts positioned therein to cool the airfoil 100. In some embodiments, for example, the inserts may direct the coolant onto the interior surface of the exterior wall 102 to facilitate impingement cooling. In alternate embodiments, the airfoil 100 may define one cavity, three cavities, or four or more cavities.

Figure 5:
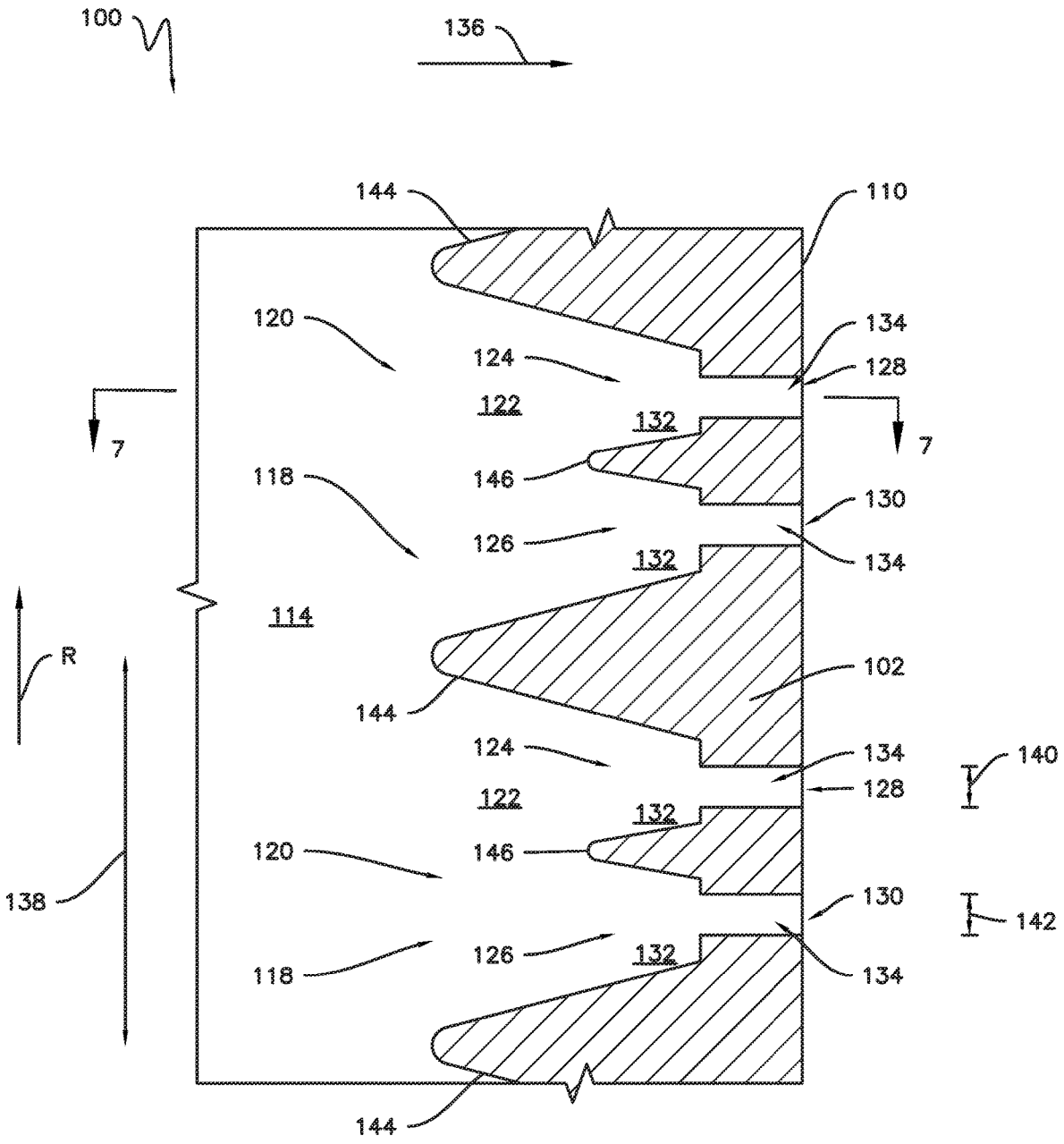
FIG. 5 is a cross-sectional view of one embodiment of an airfoil taken generally about line 5-5 in FIG. 4 in accordance with embodiments of the present disclosure.

Referring now to FIG. 5, the exterior wall 102 defines one or more trailing edge cooling passages 118 extending through the exterior wall 102 at the trailing edge 110 thereof. As will be described in greater detail below, at least a portion of the coolant in the aft cavity 114 flows through the trailing edge cooling passages 118, thereby cooling a portion of the exterior wall 102 proximate to the trailing edge 110. In the embodiment shown in FIG. 5, the exterior wall 102 defines two trailing edge cooling passages 118. In alternate embodiments, however, the exterior wall 102 may define any suitable number of trailing edge cooling passages 118.

As shown in FIG. 5, each trailing edge cooling passage 118 includes various portions. More specifically, each trailing edge cooling passage 118 includes an inlet 120 in fluid communication with and positioned downstream of the aft cooling cavity 114. Each trailing edge cooling passage 118 also includes a first portion 122 in fluid communication with and positioned downstream of the corresponding inlet 120. Each trailing edge cooling passage 118 further includes a second portion 124 and a third portion 126, each being in fluid communication with and positioned downstream of the corresponding first portion 122. Additionally, each trailing edge cooling passage 118 includes a first outlet 128 in fluid communication with and positioned downstream of the corresponding second portion 124 and a second outlet 130 in fluid communication with and positioned downstream of the corresponding third portion 126. As such, the first and second outlets 128, 130 are defined by the exterior wall 102 at the trailing edge 110 thereof. In alternate embodiments, each trailing edge cooling passage 118 may include additional portions (not shown) in fluid communication with the corresponding first portion 122. That is, in some embodiments, trailing edge cooling passage 118 may include three, four, or more portions in fluid communication the corresponding first portion 122. In such embodiments, each additional portion of the trailing edge cooling passage 118 may include a corresponding outlet.

In some embodiments, each second and third portion 124, 126 may include an upstream section 132 and a downstream section 134. As shown, each upstream section 132 is in fluid communication with the first portion 122 of the corresponding trailing edge cooling passage 118. Conversely, each downstream section 134 is in fluid communication with the corresponding outlet 128, 130. In alternate embodiments, each second and third portion 124, 126 may include additional sections or only one section.

As shown in FIG. 5, each trailing edge cooling passage 118 tapers or narrows in a downstream direction (e.g., as indicated by arrow 136) as it extends from the inlet 120 to the outlets 128, 130. More specifically, each inlet 120 defines an inlet diameter 138. Each first portion 122 narrows as it extends in the downstream direction 136 from the inlet 120 to the second and third portions 124, 126. For example, each first portion 122 may narrow in the radial direction R as shown in FIGS. 5 and/or in the circumferential direction C as shown in FIG. 7. In the embodiment shown in FIG. 5, the upstream section 132 of each second and third portion 124, 126 narrows as it extends in the downstream direction 136 from the first portion 122 to the downstream section 134. For example, the upstream section 132 of each second and third portion 124, 126 may narrow in the radial direction R and/or in the circumferential direction C (FIG. 7). In the embodiment shown in FIG. 6, however, the upstream section 132 of each second and third portion 124, 126 may have a constant diameter as it extends in the downstream direction 136 from the first portion 122 to the downstream section 134. As shown, the downstream section 134 of each second and third portion 124, 126 may have a constant diameter as it extends in the downstream direction 136 from the upstream portion 132 to the outlet 128, 130. In alternate embodiments, however, the downstream sections 136 may narrow in the downstream direction 136. Furthermore, the first outlet 128 has a first outlet diameter 140 and the second outlet 130 has a second outlet diameter 142. The inlet diameter 138 is greater than the first and second outlet diameters 140, 142. Additionally, the first and section outlet diameters 140, 142 may be the same as shown in FIG. 5 or different. Nevertheless, the trailing edge cooling passages 118 may have any suitable configuration.

Figure 6:
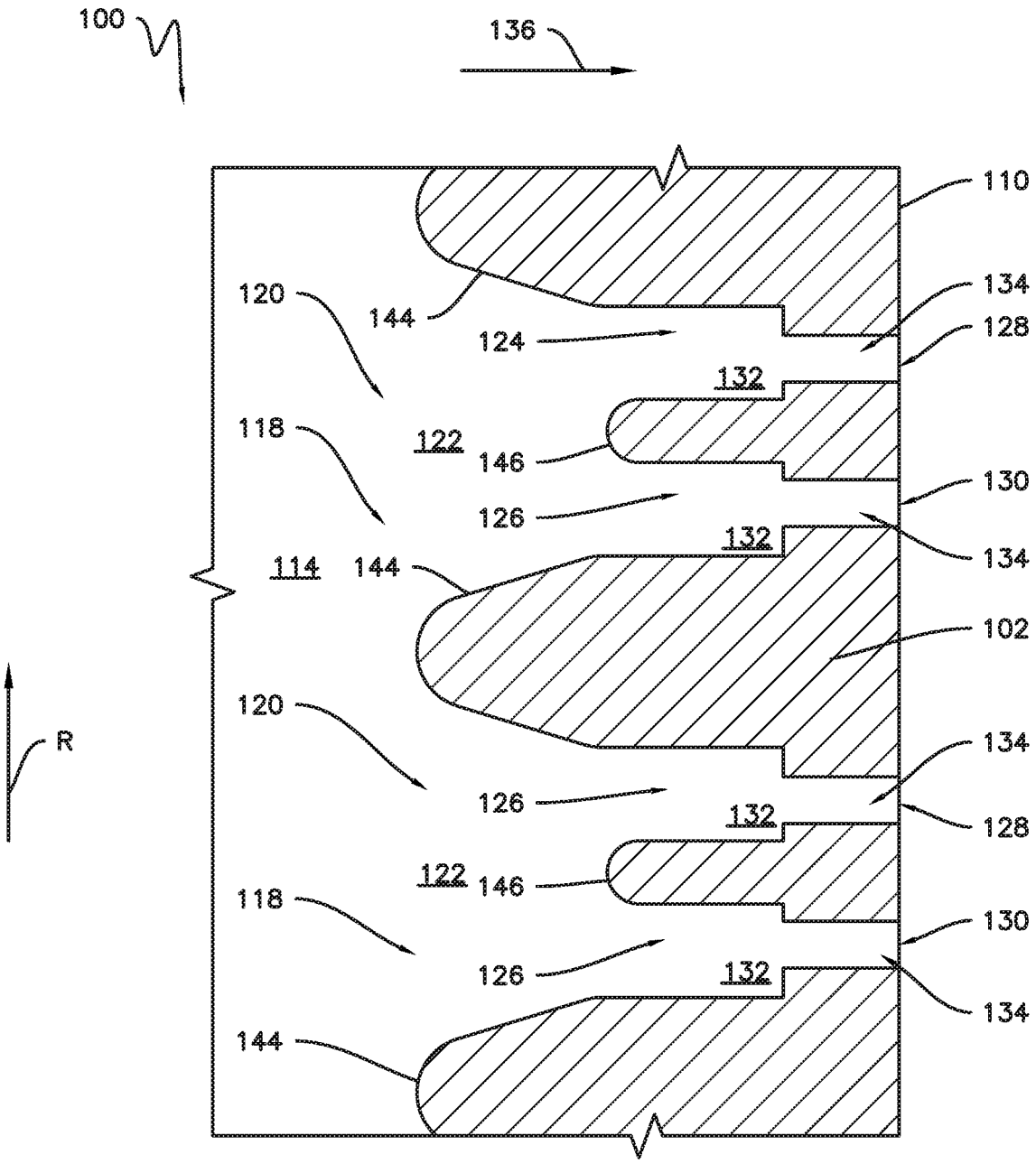
FIG. 6 is a cross-sectional view of another embodiment of an airfoil taken generally about line 5-5 in FIG. 4 in accordance with embodiments of the present disclosure.
Figure 7:
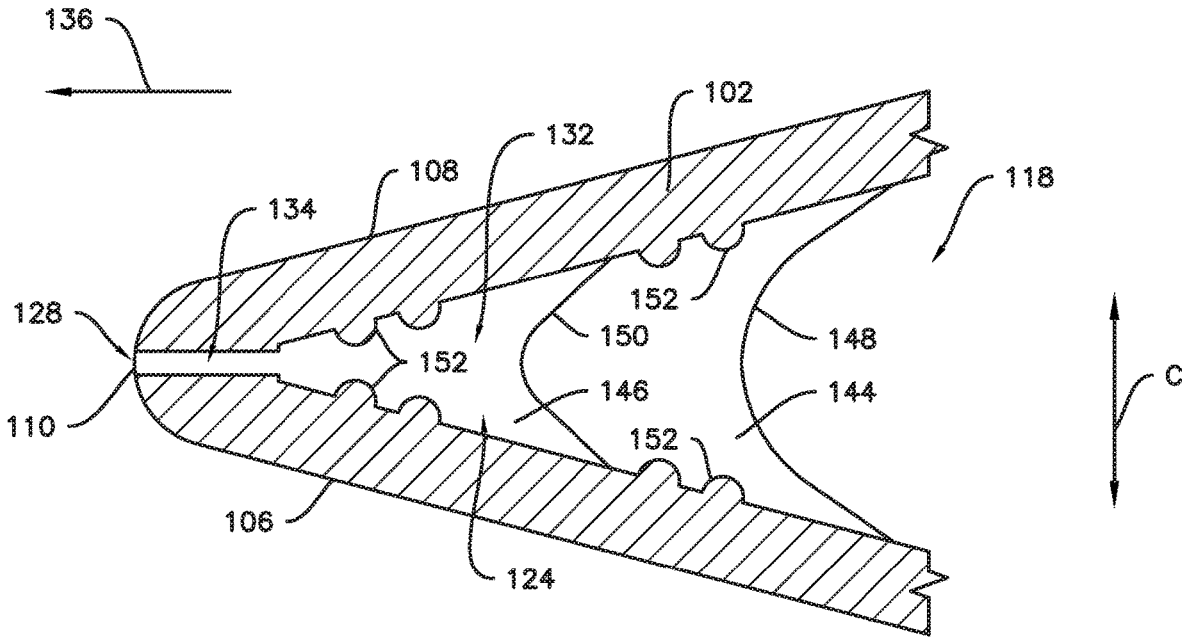
FIG. 7 is an alternate cross-sectional view of the airfoil taken generally about line 7-7 in FIG. 5 in accordance with embodiments of the present disclosure.

Referring now to FIGS. 5-7, the airfoil 100 may include various ribs for separating the trailing edge cooling passages 118. More specifically, one or more first ribs 144 may extend outward (e.g., upstream) from the exterior wall 102, thereby separating adjacent trailing edge cooling passages 118. In this respect, each adjacent pair of trailing edge cooling passages 118 may be radially spaced apart by one of the first ribs 144. Furthermore, one or more second ribs 146 may extend outward (e.g., upstream) from the exterior wall 102, thereby separating the second and third portions 124, 126 of the corresponding trailing edge cooling passage 118. As such, the second and third portions 124, 126 may be radially spaced apart by the second ribs 146. The first ribs 144 may extend upstream from the exterior wall 102 a greater distance than the second ribs 146. As shown in FIG. 7, leading edges 148 of the first ribs 144 and leading edges 150 of the second ribs 146 may be curved. For example, the circumferentially central portions of the leading edges 148, 150 may be positioned downstream of the circumferentially outer portions of the leading edges 148, 150 (i.e., the portions of the leading edges 148, 150 positioned proximate to the exterior wall 102). That is, the leading edges 148, 150 may be convex in the downstream direction 136. Additionally, the ribs 144, 146 may narrow in the radial direction R (FIG. 5) and/or in the circumferential direction C (FIG. 7) as the ribs 144, 146 extend in the downstream direction 136. In alternate embodiments, however, ribs 144, 146 may have any suitable configuration.

Referring particularly to FIG. 7, one or more turbulators 152 may be positioned within the trailing edge cooling passages 118. In particular, the turbulators 152 may be positioned on the interior surface of the exterior wall 102 (as shown in FIG. 7) or on the ribs 144, 146. As such, the turbulators 152 may create turbulence in the coolant flowing through trailing edge cooling passages 118 to increase the rate of heat transfer to the coolant. In the embodiment shown in FIG. 7, the turbulators 152 are hemispherical projections. In alternate embodiments, however, the turbulators 152 may be projections of any suitable shape (e.g., triangular, cylindrical, etc.), dimples or other depressions/voids, or surface roughness (e.g., the surface roughness associated with additive manufacturing).

Figure 8:
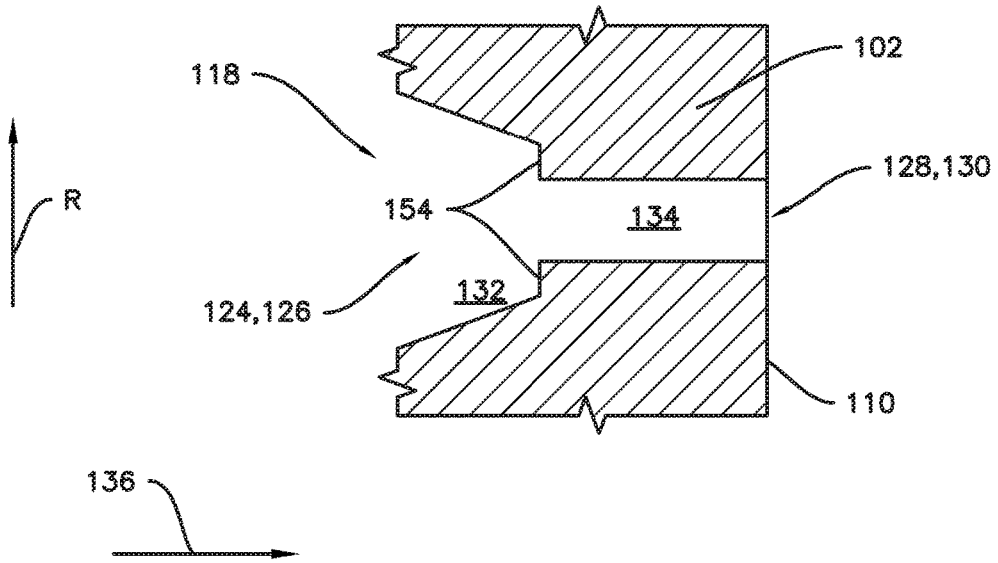
FIG. 8 is an enlarged cross-sectional view of the airfoil shown in FIG. 5 in accordance with embodiments of the present disclosure.

As shown in FIG. 8, in some embodiments, the trailing edge cooling passages 118 may include a shoulder 154, which transitions between the upstream and downstream sections 132, 134 of the second and third portions 126, 128. Specifically, the abrupt diameter change created by the shoulder 154 increases the heat transfer rate proximate to the shoulder 154. By positioning the shoulder 154 proximate to the trailing edge 110 (i.e., between the upstream and downstream sections 132, 134), the heat transfer rate at the trailing edge 110 may be increased. In alternate embodiments, however, there may be a smooth or substantially smooth transition between the upstream and downstream sections 132, 134.

In some embodiments, the airfoil 100 or a trailing edge coupon (not shown) of the airfoil 100 is formed via additive manufacturing. The term "additive manufacturing" as used herein refers to any process which results in a useful, three-dimensional object and includes a step of sequentially forming the shape of the object one layer at a time. Additive manufacturing processes include three-dimensional printing (3DP) processes, laser-net-shape manufacturing, direct metal laser sintering (DMLS), direct metal laser melting (DMLM), plasma transferred arc, freeform fabrication, etc.

A particular type of additive manufacturing process uses an energy beam, for example, an electron beam or electromagnetic radiation such as a laser beam, to sinter or melt a powder material. Additive manufacturing processes typically employ metal powder materials or wire as a raw material. Nevertheless, the airfoil 100 may be constructed using any suitable manufacturing process.

In operation, the trailing edge cooling passages 118 provides cooling to the portions of the airfoil 100 proximate to the trailing edge 110. More specifically, the coolant is directed into the cooling cavities 112, 114. At least a portion of the cooling air in the aft cooling cavity 114 then flows through the trailing edge cooling passages 118, thereby convectively cooling the portions of the airfoil 100 proximate to the trailing edge 110. After flowing through the trailing edge cooling passages 118, the coolant is exhausted into the flow combustion gases 40.

The trailing edge cooling passages 118 provide improved cooling to the portions of the airfoil 100 proximate to the trailing edge 110. As described in greater detail above, the first portion 122 of the trailing edge cooling passages 118 divides into the second and third portions 124, 126 of the trailing edge cooling passages 118. As such, the upstream portions of the trailing edge cooling passages 118 (i.e., the first portion 122) are relatively wide compared to the downstream portions of the trailing edge cooling passages 118 (i.e., the second and third portions 124, 126). The greater width of the upstream portions of the trailing edge cooling passages 118 maintains the cooling capacity of the coolant such that the coolant may effectively cool the narrower downstream portions of the of the trailing edge cooling passages 118 proximate to the trailing edge 110.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A turbomachine airfoil, comprising:

an exterior wall including a trailing edge, the exterior wall defining a radially-extending cooling cavity and one or more trailing edge cooling passages extending through the exterior wall, each trailing edge cooling passage comprising:

an inlet in fluid communication with the cooling cavity, the inlet having an inlet diameter;

a first portion in fluid communication with the inlet, the first portion narrowing in a downstream direction;

a second portion in fluid communication with the first portion, the second portion including a first outlet defined by the exterior wall at the trailing edge, the first outlet having a first outlet diameter; and a third portion in fluid communication with the first portion, the third portion including a second outlet defined by the exterior wall at the trailing edge, the second outlet having a second outlet diameter, the first outlet diameter and the second outlet diameter being less than the inlet diameter, wherein a rib extending upstream from the trailing edge is positioned between the second portion and the third portion, and wherein the second and third portions each include an upstream section and a downstream section positioned downstream of the upstream section, each upstream section narrowing in the downstream direction, and wherein the second and third portions each include a shoulder between the upstream and downstream sections.

2. The turbomachine airfoil of claim 1, wherein the first portion radially narrows in the downstream direction.

3. The turbomachine airfoil of claim 1, wherein each upstream section radially narrows in the downstream direction.

4. The turbomachine airfoil of claim 1, wherein each downstream section comprises a constant diameter.

5. The turbomachine airfoil of claim 1, wherein the second and third portions are radially spaced apart by the rib.

6. The turbomachine airfoil of claim 1, wherein a leading edge of the rib is curved.

7. The turbomachine airfoil of claim 1, further comprising:

one or more turbulators positioned within each trailing edge cooling passage.

8. The turbomachine of claim 1, wherein each upstream section radially narrows in the downstream direction.

9. The turbomachine of claim 1, wherein each downstream section comprises a constant diameter.

10. The turbomachine airfoil of claim 1, wherein the first portion extends from an upstream end to a downstream end in the downstream direction, the downstream end including a downstream end diameter, the downstream end diameter being less than the inlet diameter.

11. A turbomachine, comprising:

one or more turbine section components, each turbine section component including one or more airfoils, each airfoil including:

an exterior wall including a trailing edge, the exterior wall defining a radially-extending cooling cavity and one or more trailing edge cooling passages extending through the exterior wall, each trailing edge cooling passage comprising:

an inlet in fluid communication with the cooling cavity, the inlet having an inlet diameter;

a first portion in fluid communication with the inlet, the first portion narrowing in a downstream direction;

a second portion in fluid communication with the first portion, the second portion including a first outlet defined by the exterior wall at the trailing edge, the first outlet having a first outlet diameter; and a third portion in fluid communication with the first portion, the third portion including a second outlet defined by the exterior wall at the trailing edge, the second outlet having a second outlet diameter, the first outlet diameter and the second outlet diameter being less than the inlet diameter, wherein a rib extending upstream from the trailing edge is positioned between the second portion and the third portion, and wherein the second and third portions each include an upstream section and a downstream section positioned downstream of the upstream section, each upstream section narrowing in the downstream direction, and wherein the second and third portions each include a shoulder between the upstream and downstream sections.

12. The turbomachine of claim 11, wherein the first portion radially narrows in the downstream direction.

13. The turbomachine of claim 11, wherein the second and third portions are radially spaced apart by the rib.

14. The turbomachine of claim 11, wherein a leading edge of the rib is curved.

15. The turbomachine of claim 11, further comprising:

one or more turbulators positioned within each trailing edge cooling passage.

16. The turbomachine of claim 11, wherein the one or more turbine section components are nozzles.

* * * * *